United States Patent [19]

Stern et al.

[11] Patent Number: 4,468,673

[45] Date of Patent: Aug. 28, 1984

[54] FREQUENCY SCAN ANTENNA UTILIZING SUPPORTED DIELECTRIC WAVEGUIDE

[75] Inventors: Richard A. Stern, Allenwood; Richard W. Babbitt, Fairhaven; John Borowick, Bricktown, all of N.J.

[73] Assignee: The United States of America as represented by the Secretary of the Army, Washington, D.C.

[21] Appl. No.: 409,201

[22] Filed: Aug. 18, 1982

[51] Int. Cl.[3] ..... H01Q 13/28

[52] U.S. Cl. ..... 343/785; 343/770

[58] Field of Search ..... 343/785, 700 MS, 770

[56] References Cited

U.S. PATENT DOCUMENTS

| | | | |
|---|---|---|---|
| 2,659,817 | 11/1953 | Cutler | 343/785 |
| 3,018,480 | 1/1962 | Thourel | 343/785 |
| 3,959,794 | 5/1976 | Chrepta et al. | 343/701 |
| 4,092,647 | 5/1978 | Borowich et al. | 343/768 |

FOREIGN PATENT DOCUMENTS

| | | | |
|---|---|---|---|
| 1194342 | of 1970 | United Kingdom | 343/785 |

OTHER PUBLICATIONS

A Distributed Feedback Dielectric Waveguide Oscillator with a Built-In Leaky Waveguide Antenna, by Song et al., 1979 IEEE MTT-S International Microwave Symposium Digest, Orlando, Florida, (Apr. 30-May 2, 1979).

K. L. Klohn et al., "Silicon Waveguide Frequency Scanning Linear Array Antenna", 10/78 IEEE Transactions on Microwave Theory and Techniques, vol. MTT-26, No. 10.

T. N. Trinh et al., "Horn Image Guide Leaky-Wave Antenna", 1981 IEEE MTT-S International Microwave Symposium Digest.

K. Solbach, "E-Band Leaky Wave Antenna Using Dielectric Image Line with Etched Radiating Elements", 1979 IEEE MTT-S International Microwave Symposium Digest.

*Primary Examiner*—Eli Lieberman
*Assistant Examiner*—Karl Ohralik
*Attorney, Agent, or Firm*—Anthony T. Lane; Jeremiah G. Murray; John W. Redman

[57] ABSTRACT

A dielectric waveguide of rectangular cross-section has periodically spaced, transverse slots in its upper surface. When traveling waves of varying millimeter wavelength frequencies are applied to the waveguide, the slots perturb the waves resulting in radiation having a main lobe that scans as the frequency changes. The antenna is made rigid by the use of a dielectric support.

6 Claims, 6 Drawing Figures

FREQUENCY SCAN ANTENNA UTILIZING SUPPORTED DIELECTRIC WAVEGUIDE

The invention described herein may be manufactured, used and licensed by or for the Government for Governmental purposes without the payment to me of any royalties thereon.

BACKGROUND OF THE INVENTION

This invention relates generally to millimeter wavelength antennas, and more particularly to a supported dielectric waveguide frequency scan antenna.

Frequency scan antennas have utility in radar systems such as those required for surveillance, obstacle avoidance and target acquisition. Such antennas are preferably structurally compact, lightweight and simple in design without sacrificing ruggedness.

K. L. Klohn et al in an article entitled "Silicon Waveguide Frequency Scanning Linear Array Antenna" disclose a frequency scan antenna having a dielectric rod of rectangular cross-section. One side of the rod is provided with periodically spaced metal perturbations formed with copper foil. This article was published in the IEEE Transactions on Microwave Theory and Techniques, Vol. MTT-26, No. 10, October 1978.

A somewhat similar millimeter wavelength dielectric antenna is disclosed by T. N. Trinh et al in an article entitled "Horn Image Guide Leaky-Wave Antenna". The antenna in this case is located in a groove in a metal ground plane and is provided with metal flares. This article was published in the 1981 IEEE MTT-S International Microwave Symposium Digest.

The foregoing structures, because they incorporate metal, are subject to transmission conductor loss. Moreover, the correct positioning of the metal strips and the bonding of them present some difficulties.

In an article entitled "E-Band Leaky Wave Antenna Using Dielectric Image Line with Etched Radiating Elements", K. Solbach describes a frequency scanned antenna using a dielectric image line with etched metallic disks on top of the waveguide as the radiating elements. This was published in the 1979 IEEE MTT-S International Microwave Symposium Digest. As indicated above, transmission conductor loss results from this arrangement.

T. Itoh in an article entitled "Leaky-Wave Antenna and Band-Reject Filter for Millimeter-Wave Integrated Circuits" in the IEEE MTT-S International Microwave Symposium Digest, 1977, describes an inverted strip dielectric waveguide. In this structure the guide is mounted above a dielectric strip having periodic grooves. The guiding layer has a dielectric constant of $\epsilon'=3.75$.

K. Solbach has published in the IEEE Transactions on Microwave Theory and Techniques, Vol. MTT-29, No. 1, January 1981, an article entitled "Slots in Dielectric Image Lines as Mode Launchers and Circuit Elements". The slots referred to are made in the metal ground plane positioned below the dielectric waveguide.

In U.S. Pat. No. 3,959,794, M. M. Chrepta et al disclose a semiconductor waveguide antenna having parallel and uniformly spaced conductive wires embedded in the radiating surface.

In U.S. Pat. No. 4,092,647, J. J. Borowich et al disclose an antenna with electronic beam scanning having a slotted metal waveguide.

It is therefore an object of this invention to provide a frequency scanned dielectric antenna which avoids the transmission conductor losses resulting from the use of metal strips or wires.

It is also an object of this invention to provide a frequency scanned antenna in which the dielectric waveguide contains the necessary configuration to produce the scanned radiation beam.

It is a further object of this invention to provide a frequency scanned antenna which is uncomplicated in design and rugged in structure.

SUMMARY OF THE INVENTION

A millimeter wavelength dielectric waveguide frequency scan antenna is fabricated with a plurality of periodically spaced transverse slots cut in the upper surface of the waveguide. A wide scan is achieved through the use of high dielectric constant material for the waveguide. A rigid antenna results from the addition of a support fabricated from a low dielectric constant material.

DESCRIPTION OF THE PREFERRED EMBODIMENT

Figure 1:
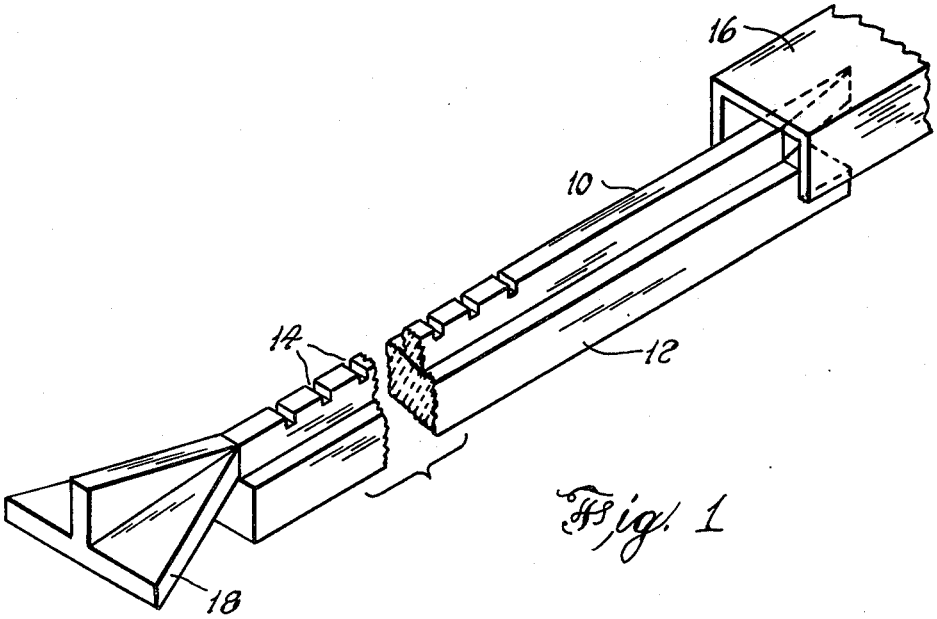
FIG. 1 represents schematically a supported waveguide frequency scanned antenna.

Referring to FIG. 1, a dielectric waveguide 10 is shown mounted on a dielectric support 12. Periodically spaced, transverse, slots 14 on the top dielectric waveguide 10 cause the slotted portion of it to function as an antenna. Dielectric waveguide 10 has a transition from a metal waveguide 16 at one end, and is bonded to an absorber 18 at the other end.

A traveling wave of millimeter wavelength is propagated in dielectric waveguide 10 from metal waveguide 16. The traveling wave is perturbed by slots 14 giving rise to radiation from the antenna. Absorber 18 prevents the reflection back to waveguide 10 of any traveling wave energy which has not been radiated by the antenna by absorbing it.

Figure 2:
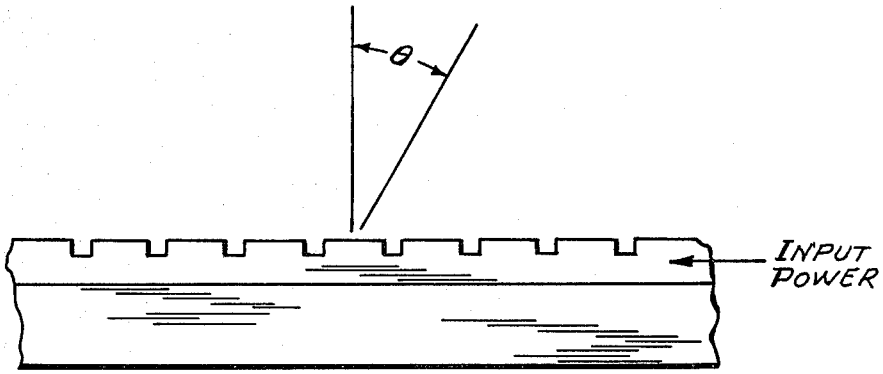
FIG. 2 is an elevation of a portion of the antenna of FIG. 1.

The radiation is a far-field radiation pattern with a main lobe at an angle $\theta$ measured from the normal as shown in FIG. 2. The angle $\theta$ is a function of the dielectric constant of the waveguide material ($\epsilon'$), the cross-sectional dimensions of the waveguide (a,b), the slot spacing (d), and the operating frequency ($f_o$).

Figure 3:
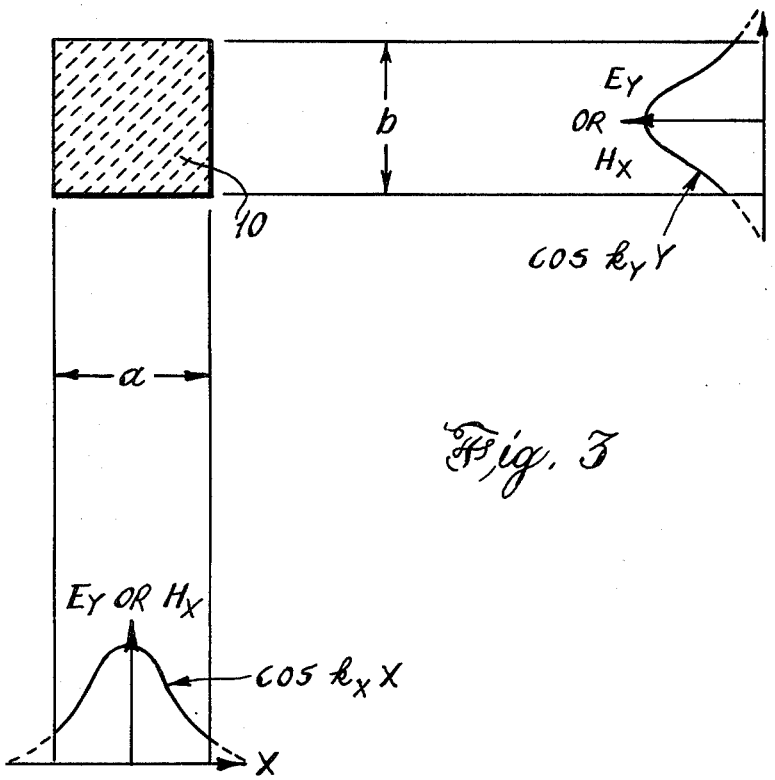
FIG. 3 is a cross-section of the antenna of FIG. 1, together with the travelling wave configurations.

In one embodiment which was built and tested, the dielectric material which was used was magnesium titanate, for which $\epsilon'=16$. The cross-section of the waveguide 10 is shown in FIG. 3 together with the millimeter wave configurations within and outside of the waveguide. As shown, the $E_{11}^y$ mode is a cosine function within the waveguide, and it decays exponentially outside in both transverse directions. The waveguide dimensions were a=0.135 cm and b=0.178 cm.

Figure 4:
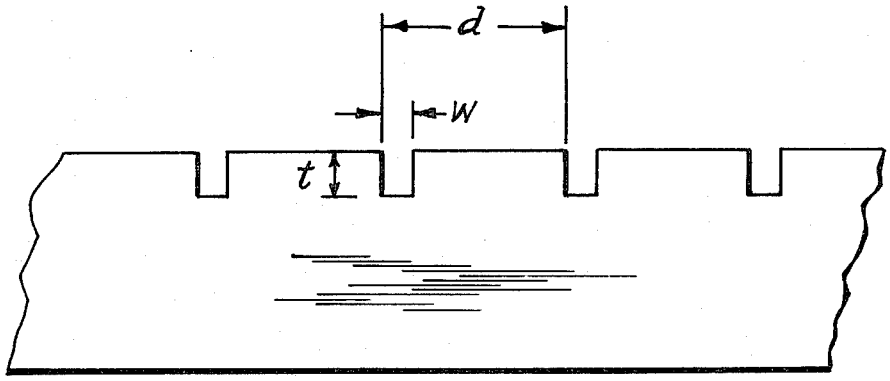
FIG. 4 is a detail showing slot structure.

FIG. 4 shows the slot spacing and slot dimensions. In the embodiment built, the slot spacing was 0.353 cm corresponding to a frequency of 34.8 GHz.

As previously indicated, the angle $\theta$ shown in FIG. 2 is the angle at which the main lobe of radiation is directed. The sine of this angle is given by:

$$\sin 0=\lambda_o/\lambda_g+m\lambda_o/d$$

where $\lambda_g$ is the guide wavelength, $\lambda_o$ is the free-space wavelength corresponding to $f_o$, d is the periodic slot spacing and m is an integer corresponding to the particular spatial harmonic that is excited. Choosing $m=-1$ gives $d=\lambda_g$ for broadside operation at frequency $f_o$.

Figure 5:
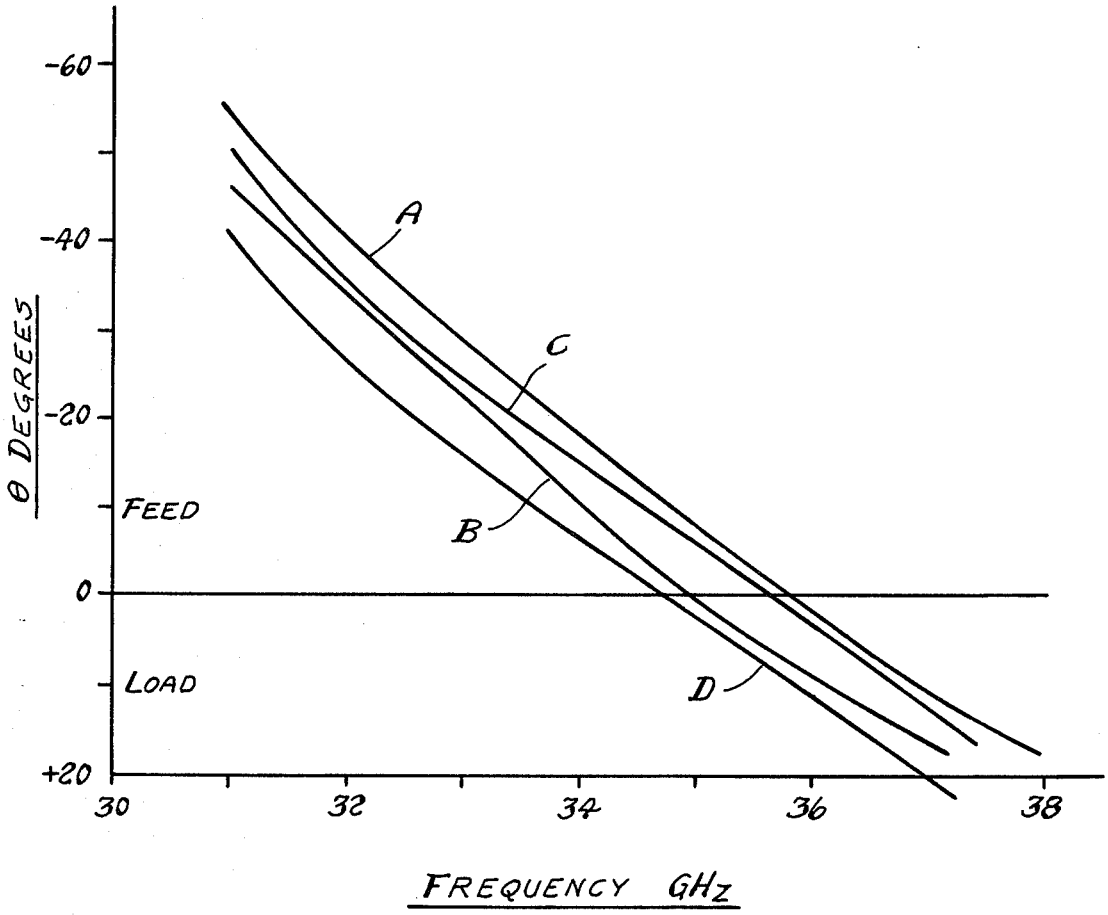
FIG. 5 is a graph showing beam angle vs. frequency for different slot sizes.

The width and depth of the slots has been varied in order to study the effect of slot geometry on aperture distribution. Given below are the dimensions tested for the slots of FIG. 4. FIG. 5 is a graph of beam angle vs. frequency for the four different slot dimensions.

| | w (cm) | t (cm) |
|---|---|---|
| A | 0.0254 | 0.0254 |
| B | 0.0254 | 0.0356 |
| C | 0.0254 | 0.0457 |
| D | 0.0127 | 0.0356 |

Figure 6:
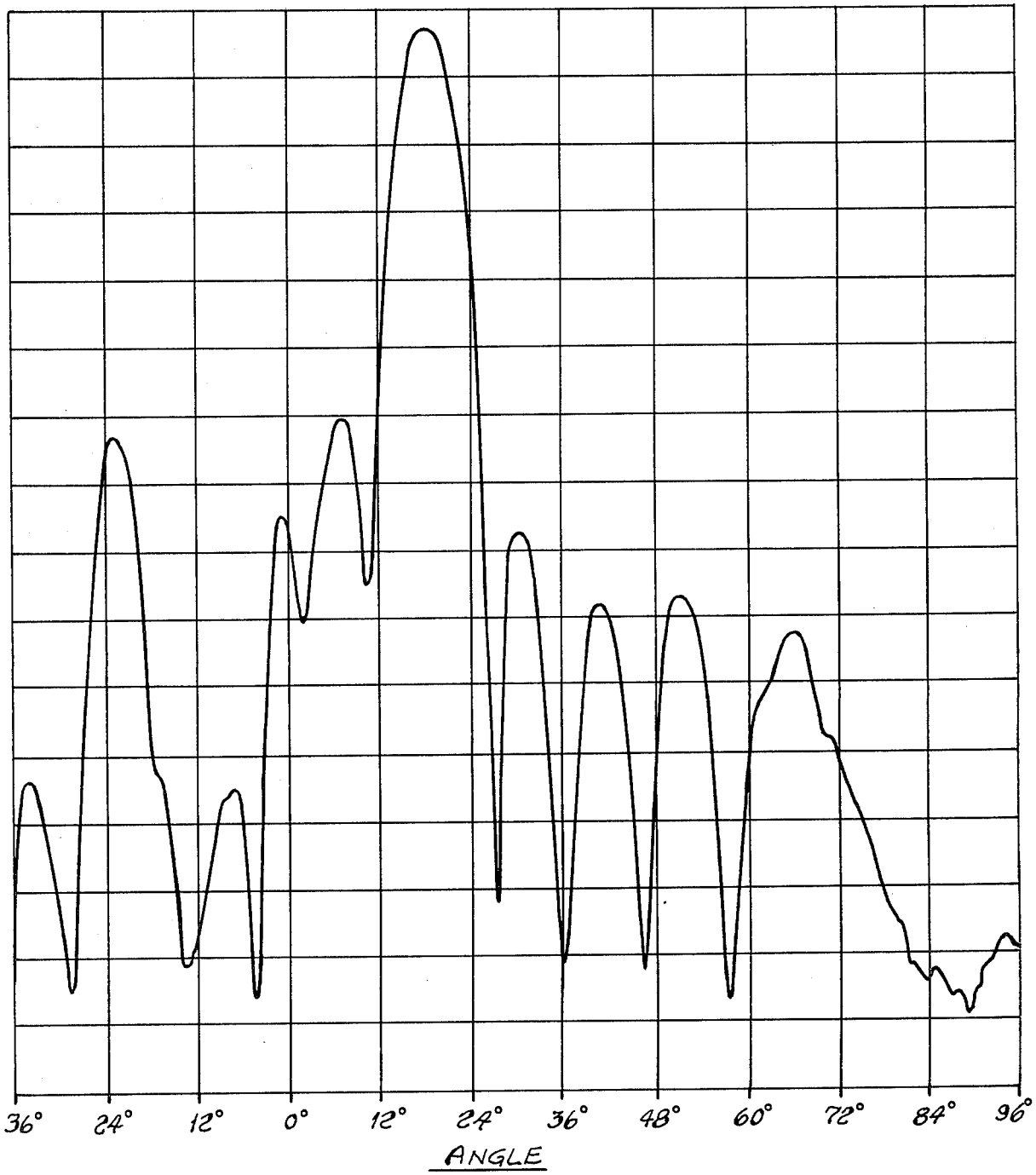
FIG. 6 shows the radiation pattern of the beam.

With the antenna operating at 34 GHz the radiation pattern is as shown in FIG. 6 with the beam pointing at $\theta=-18°$.

As shown in FIG. 5, the angle $\theta$ at which the beam is directed is almost exactly directly proportional to the frequencies of the traveling waves. Also, curve A provides a greater range of scan angles for a given range of frequencies than the curves for the other three slot configurations. At the range of frequencies beginning at 32 GHz and ending at 36 GHz, a scan of from $\theta=-40°$ to $\theta=2°$ has been achieved. The high dielectric constant of the material used for the antenna results in this greater scan capability. The scan for this dielectric antenna is about four times wider than that of a conventional slotted metal waveguide array.

The dielectric constant of the antenna was $\epsilon'=16$. Twenty slots were cut into the top of the waveguide which was mounted on a low dielectric constant ($\epsilon'=2$ to 4) support (12 in FIG. 1). The support makes the antenna rigid, while the elimination of the foil or wire perturbations used in some prior devices not only eliminates processing steps, but also transmission line conductor loss. The result is a simple design, yet rugged structure.

Although a particular embodiment of a dielectric waveguide frequency scan antenna has been illustrated and described, it will be obvious that changes and modifications can be made without departing from the spirit of the invention and the scope of the appended claims.

We claim:

1. A dielectric waveguide frequency scan antenna comprising:
   a longitudinally extending dielectric waveguide having a rectangular cross-section;
   a plurality of periodically spaced transverse slots in the upper surface of said waveguide wherein the width of said transverse slots is one tenth or smaller in relation to the separation between adjacent said slots; and
   means for applying to said waveguide millimeter wavelength traveling waves of varying frequencies.

2. A dielectric waveguide frequency scan antenna in accordance with claim 1 wherein:
   said dielectric waveguide has a dielectric support positioned below it and bonded to it.

3. A dielectric waveguide frequency scan antenna in accordance with claim 1 wherein:
   the dielectric constant of said dielectric waveguide is greater than $\epsilon'=12$ and less than $\epsilon'=18$.

4. A dielectric waveguide frequency scan antenna in accordance with claim 1 wherein:
   said slots have identical dimensions.

5. A dielectric waveguide frequency scan antenna comprising:
   a longitudinally extending dielectric waveguide having a rectangular cross-section;
   a plurality of periodically spaced transverse slots in the upper surface of said waveguide wherein the width of said transverse slots is one tenth or smaller in relation to the separation between adjacent said slots;
   a dielectric support positioned below said waveguide and bonded to it;
   a metal waveguide secured to one end of said dielectric waveguide for applying to said dielectric waveguide millimeter wavelength traveling waves of varying frequencies; and
   an absorber bonded to the other end of said dielectric waveguide.

6. A dielectric waveguide frequency scan antenna comprising:
   a longitudinally extending dielectric waveguide having a rectangular cross-section wherein:
   the dielectric constant of said dielectric waveguide is greater than $\epsilon'=12$ and less than $\epsilon'=18$;
   a metal waveguide secured to one end of said dielectric waveguide for applying to said dielectric waveguide millimeter wavelength traveling waves of varying frequencies;
   a plurality of periodically spaced transverse slots in the upper surface of said waveguide;
   a dielectric support positioned below said waveguide and bonded to it wherein:
   the dielectric constant of said support is from $\epsilon'=2$ to $\epsilon'=4.3$; and,
   an absorber bonded to the other end of said dielectric waveguide.

* * * * *